United States Patent [19]

Henery

[11] Patent Number: 4,794,872

[45] Date of Patent: Jan. 3, 1989

[54] APPARATUS AND METHOD FOR DISPOSING OF WASTE MATERIAL

[75] Inventor: Maurice D. Henery, Evanston, Ill.

[73] Assignee: Marblehead Lime Company, Chicago, Ill.

[21] Appl. No.: 107,788

[22] Filed: Oct. 13, 1987

[51] Int. Cl.[4] ..... F23G 7/04

[52] U.S. Cl. ..... 110/346; 110/226; 110/238; 110/246

[58] Field of Search ..... 110/226, 246, 238, 346

[56] References Cited

U.S. PATENT DOCUMENTS

| | | | |
|---|---|---|---|
| 3,218,995 | 11/1965 | Yoshihara et al. | 110/226 X |
| 3,954,069 | 5/1976 | Loken | 110/226 X |
| 4,232,614 | 11/1980 | Fitch et al. | 110/246 X |
| 4,431,405 | 2/1984 | Eatherton | 110/226 X |
| 4,516,511 | 5/1985 | Kuo | 110/226 X |
| 4,639,217 | 1/1987 | Adams | 110/226 X |

*Primary Examiner*—Edward G. Favors

*Attorney, Agent, or Firm*—James P. Ryther

[57] ABSTRACT

A system for treating liquid containing waste material which includes a reaction vessel for treating other material to achieve a reaction which includes the formation of hot gases. The system includes a dryer adapted to receive the hot gases from the reaction vessel, and these hot gases are introduced to the dryer for heating the waste material to a temperature in excess of the boiling point of the liquid in the waste material. The waste material is circulated within the dryer to maximize the exposure of the waste material to the heat in the hot gases. Waste gas generated by the boiling of the liquid is withdrawn from the dryer, and a solid portion of the waste material is discharged from the dryer and delivered to the reaction vessel. This solid portion provides at least some of the fuel value required for operating the heating means of the reaction vessel. The hot gases from the reaction vessel are preferably introduced to a longitudinally and centrally located pipe cluster of the dryer whereby, upon rotation of the dryer, the waste material is continuously moved back and forth between said pipe cluster and the inner wall surface of the dryer.

14 Claims, 1 Drawing Sheet

APPARATUS AND METHOD FOR DISPOSING OF WASTE MATERIAL

BACKGROUND OF THE INVENTION

The invention relates generally to systems for disposing of liquid-containing toxic and non-toxic waste materials. In particular, the invention provides an apparatus and method particularly useful for safely and efficiently disposing of waste material such as sludge resulting from sewage systems.

Various attempts have been made to dispose of waste materials through the use of incinerators. Such attempts have involved use of rotary kilns or furnaces of a similar nature, and reference is made to U.S. Pat. Nos. 723,959 (Wheildon); 2,212,062 (Duerr et al); 2,501,977 (Wallerstedt et al.); 3,436,061 (Zinn); 3,584,609 (Lerner); and 3,861,336 (Koyanagi) as illustrative of such prior attempts.

Disposal of waste materials with such systems has been satisfactory to some extent, however, difficulties remain. Such difficulties relate to a continuing need for more efficient systems for waste disposal. These needs are exacerbated by increasing waste generation and accumulation in the face of more restrictive environmental regulation. Furthermore, hazardous wastes have recently been recognized as presenting more significant problems than earlier thought, and therefore effective means for disposing of waste of this type are particularly desirable.

Kerwin U.S. Pat. No. 4,546,711 discloses a system utilizing a basic preheater-type kiln of modified design for incineration of both toxic and non-toxic waste materials including sewage sludge. That invention contemplates the use of existing kilns to provide an efficient waste incinerator capable of destroying a variety of waste materials. The processes and apparatus of that invention are particularly useful in instances where large amounts of wastes must be handled on a substantially continuous basis.

SUMMARY OF THE INVENTION

The system of this invention also involves the use of a kiln, such as a rotary kiln. In this system, the hot gases developed during the kiln operation are delivered to a waste heat dryer. These gases are brought into a heat transfer relationship with sludge or other liquid-containing waste introduced to the dryer whereby the heat present in the hot kiln gases can be utilized for separating the liquid (as by the formation of steam) from the solid sludge material.

The waste heat dryer structure of the invention preferably includes means which insure maximum exposure of the waste material to the hot gases introduced from the kiln. To achieve this, the gases are introduced to the interiors of tubes which are assembled in a cluster within the dryer. Means are provided for delivering the liquid-containing waste onto the exterior of the tube cluster, and the dryer is rotated so that different areas of the cluster surfaces are contacted by the incoming waste.

The configuration of the tube cluster also enhances heat transfer to the waste by reason of the fact that pockets are formed between tubes which serve to temporarily hold waste immediately against cluster surfaces. As the cluster rotates, the waste drops away and is replaced by other waste falling onto the cluster surfaces.

The circulation of waste to and from the cluster surfaces is most effectively achieved by providing vanes extending radially inwardly from the interior dryer surface. These vanes serve to continuously lift waste material from the bottom to the top of the dryer which eventually results in the material dropping downwardly onto the cluster. The material circulation thus results from the cooperative operation of the Pipe cluster centrally located in the dryer and of the vanes spaced outwardly therefrom and located on the interior wall surfaces of the dryer.

A significant benefit of the system of the invention is achieved by virtue of the fact that dry waste solids produced in the dryer by virtue of the liquid removal can be utilized for their fuel values. In a particularly advantageous aspect of the invention, this solid material can be conveyed to the burner of a lime kiln forming part of the system. The fuel value can then be utilized for supplying all or a portion of the fuel value necessary for operating the kiln.

Where the liquid in the sludge fed to the dryer is primarily water, steam will be generated in the dryer and this steam can be safely conducted to a condenser for converting the steam to water. Ordinarily, this water can be most conveniently handled by returning it to an available sewer system.

Dust particles and the like which cannot be conveniently transported with other solids for use of the fuel value, can be sent to a baghouse for safe disposal.

DESCRIPTION OF THE PREFERRED EMBODIMENTS

Figures 1, 2:
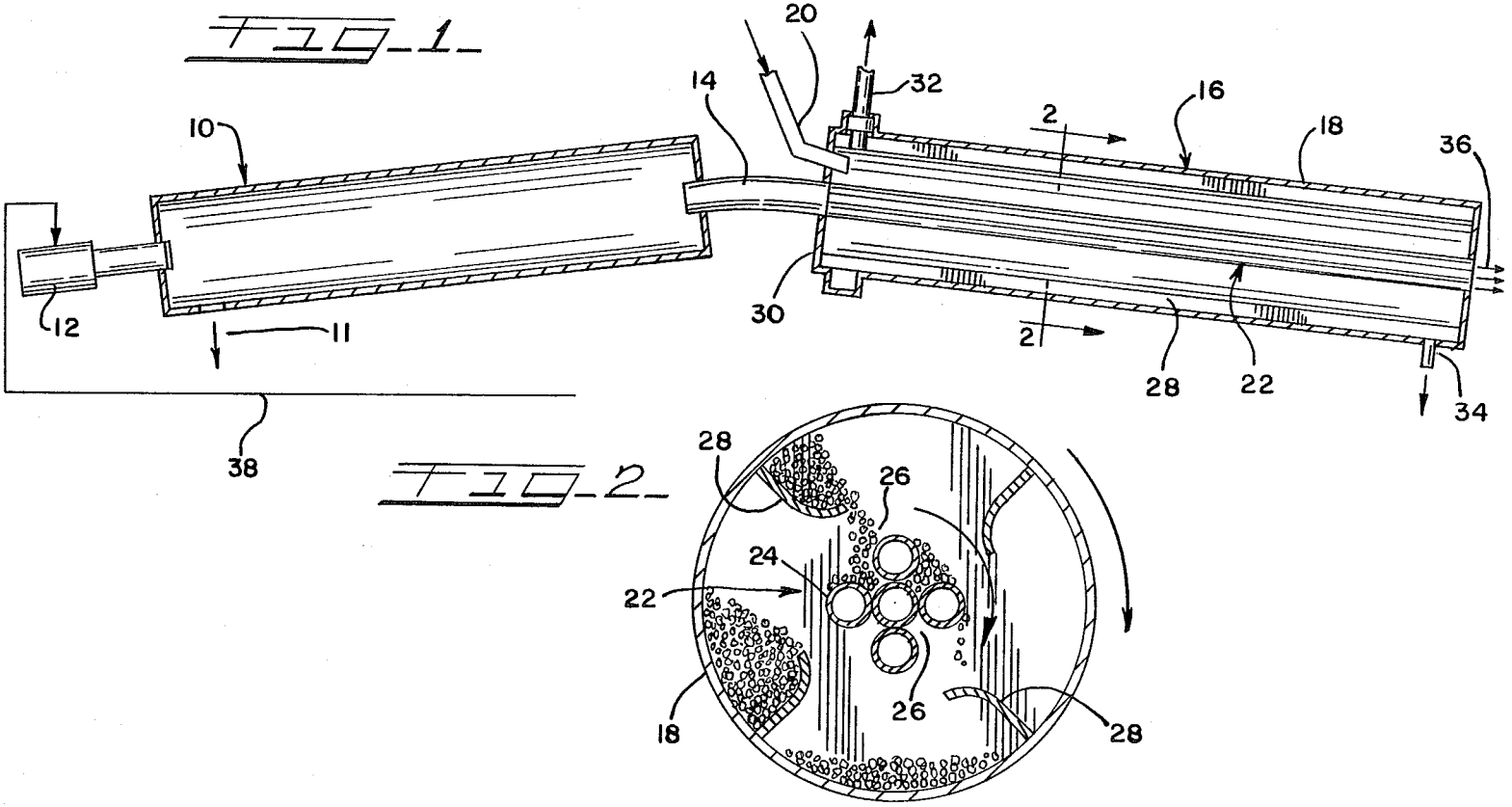
FIG. 1 is a schematic view of the rotary kiln and waste disposal system of the invention; and, FIG. 2 is a cross-sectional view of a waste heat dryer of the type preferably utilized in the system.

The drawings illustrate a reaction vessel 10 which may comprise a rotary kiln of the type typically used for treating limestone. Generally speaking, such an operation involves calcining with the resulting reaction leading to the formation of hot gases and solid material, the latter being discharged as shown schematically by the numeral 11 in FIG. 1. A conventional burner 12 provides the heating means for this reaction vessel. The outlet pipe 14 is employed for discharging hot gases from the kiln 10 and delivering the gases to a rotary dryer 16. The dryer 16 comprises a cylindrical housing 18, and any conventional means may be employed for achieving rotation of the dryer. The kiln 10 is also intended to be rotated by conventional means with the outlet pipe 14 being preferably journalled at its ends in any conventional fashion.

The dryer 16 includes an inlet pipe 20 for the introduction of waste material comprising sludge or the like into the dryer 16. The waste material will typically include a substantially liquid component consisting principally of water, for example in excess of 50 percent water, by weight.

The dryer also includes a pipe cluster 22 which is mounted for rotation with the cylindrical housing 18. The pipe cluster includes a plurality of pipes 24 which are arranged so that longitudinal trough-like areas 26 are defined along the length of the cluster. A plurality of vanes 28 extend radially inwardly from the interior of the wall 18 and, as shown in FIG. 2, these vanes serve as holding means for solid material within the dryer in the course of dryer rotation. The vanes shown define a "scoop" cross-section, but any configuration is contemplated as long as substantial amounts of the waste material is lifted up and then allowed to fall onto the pipe cluster.

The dryer also includes a manifold 30 which communicates with outlet pipe 32 for discharge of gases formed during the drying operation. Dry solid material exits from the dryer as shown schematically at 34. The hot gases entering the dryer through pipe 14 progress through the pipes 24 and exit at 36.

In a typical operation of the system described, hot gases resulting from a calcining operation are introduced into pipe cluster 22 through pipe 14. The gases must be at a temperature in excess of the boiling point of the liquid component of the waste material. Accordingly, the continuous flow of gases through the pipe cluster will result in transfer of heat to the waste material to the extent that a gas component will be formed within the dryer for discharge through the outlet 32. As indicated, sludge and similar waste materials typically have a large liquid component, and by volatilizing this component, the weight of the waste material will be substantially reduced for greatly increased handling efficiency.

By reason of the rotation of the dryer housing, waste material is continuously circulated between the dryer wall surfaces and the pipe cluster. Specifically, the provision of vanes 28 results in the lifting of waste material which has collected at the bottom of the dryer housing. As this material rises, it eventually will drop downwardly onto the pipe cluster. Due to the provision of the trough-like areas 26 formed by the pipe cluster, portions of the waste material remain in intimate contact with the hot pipe surfaces at all times. There is also continuous circulation of the waste material into and out of contact with the cluster surfaces so that all or substantially all of the waste material is exposed to the high temperatures generated in the vicinity of the pipe surfaces.

Due to the incline of the dryer 16, solid material introduced through pipe 20 progresses continuously toward the end of the dryer for ultimate discharge at 34. This progressive movement along the length of the dryer also facilitates circulation of the material and insures that all or substantially all of the material is exposed to temperatures sufficient to achieve volatilization of the liquid portion of the sludge or the like.

In a typical operation characterized by the features of this invention, waste water sludge containing 75 to 80 percent water is introduced to the dryer 16. The calcination operation taking place in the rotary kiln 10 will yield flue gases at temperatures in the order of 1000° to 1200° F. whereby gases at these temperatures are introduced to the pipe cluster 22 of the dryer. The gases exiting from the pipe cluster will typically be at a temperature in the order of 400° F. and may be delivered to a baghouse or the like for removal of undesired constituents before discharge into the atmosphere.

Steam generated within the dryer will typically be delivered to a condenser, and the water thereby produced, unless containing some unusual contaminant, may be delivered to a sewer system. The gases exiting from the dryer may also include methane and other gases which can be handled with conventional systems.

Solids discharged from the dryer typically have a heat value in excess of 5000 BTU per pound. These solids are delivered, as shown at 38, back to the burner 12 of the kiln 10 for use as burner fuel. All or part of the burner fuel may be provided by such solids to achieve temperatures in the kiln in the order of 2200° F. For example. A truck, belt conveyor, or pneumatic system may be employed for delivering the solids from the dryer to the burner 12.

The system described provides a method and apparatus superior to existing systems for disposal of waste material. Particular efficiency is achieved by the fact that the dryer interposed between the lime kiln and the baghouse which typifies existing systems will act as a cooler for the gases being delivered to the baghouse. Thus, such a cooler is not required with the system of this invention. In addition, the utilization of the heat value of dry solids obtained from the waste material provides economies from the standpoint of fuel cost for operating the lime kiln.

It will be appreciated that the examples which have been provided are for illustrative purposes only since operating conditions will vary considerably depending upon the reaction material introduced to the kiln and also with respect to the character of the waste material being handled. It will also be understood that various changes and modifications may be made in the described system without departing from the spirit of the invention, particularly as defined in the following claims.

I claim:

1. A method for treating liquid-containing waste material comprising the steps of providing a reaction vessel, introducing material to be reacted to said reaction vessel, said reaction vessel including heating means for heating the vessel and the material therein to achieve a reaction which includes the formation of hot gases, providing a dryer, introducing said waste material to said dryer, introducing at least substantially all of said hot gases from said reaction vessel to said dryer for heating said waste material to a temperature in excess of the boiling point of the liquid in said waste material, circulating said waste material within said dryer to maximize the exposure of the waste material to the heat in said hot gases, withdrawing from said dryer the waste gas generated by the boiling of said liquid, discharging from said dryer a solid portion of said waste material, and delivering said solid portion to said heating means for said reaction vessel to provide at least some of the fuel value required for operating said heating means.

2. A method in accordance with claim 1 wherein said dryer includes a cluster of pipes located within said dryer and extending longitudinally and centrally of said dryer, and wherein means are provided for directing said waste material into engagement with the exterior surfaces defined by said pipe cluster, and including the steps of rotating said dryer whereby said waste material is continuously moved back and forth between said pipe cluster and the interior wall surface of said dryer, and introducing said hot gases from said vessel into the interior of said pipe cluster whereby heat from said hot gases is transmitted through the pipe walls to the waste material engaging said exterior surface.

3. A method in accordance with claim 2 including the step of inclining said dryer whereby the waste material progresses from an input location along the length of the dryer as the dryer is rotated.

4. A method in accordance with claim 2 including the step of continuously lifting the waste material to the top of the dryer and allowing the waste material to drop downwardly onto the cluster.

5. A method in accordance with claim 1 wherein said hot gases are cooled by said dryer, and including the step of delivering said hot gases from said dryer to a baghouse.

6. An apparatus for treating liquid-containing waste material comprising a reaction vessel including means for receiving material to be reacted in the reaction vessel, said reaction vessel also including heating means for heating the vessel and the material therein to achieve a reaction which includes the formation of hot gases, a dryer, means for introducing said waste material to said dryer, conduit means communicating said reaction vessel and said dryer for introducing at least substantially all of said hot gases from said reaction vessel to said dryer for heating said waste material to a temperature in excess of the boiling point of the liquid in said waste material, means formed by said dryer for circulating said waste material within said dryer to maximize the exposure of the waste material to the heat in said hot gases, means for withdrawing from said dryer the waste gas generated by the boiling of said liquid, means for discharging from said dryer a solid portion of said waste material, and means for delivering said solid portion to said heating means for said reaction vessel to provide at least some of the fuel value required for operating said heating means.

7. An apparatus in accordance with claim 6 wherein said dryer comprises a cluster of pipes extending longitudinally and centrally of said dryer, means for directing said waste material into engagement with the exterior surfaces defined by said pipe cluster, and means for rotating said dryer whereby said waste material is continuously moved back and forth between said pipe cluster and the interior wall surface of said dryer, and means for introducing said hot gases from said vessel into the interior of said pipe cluster whereby heat from said hot gases is transmitted through the pipe walls to the waste material engaging said exterior surface.

8. An apparatus in accordance with claim 7 wherein said dryer is inclined with the input location for the waste material being elevated relative to the discharge location for said waste material whereby the waste material progresses from an input location along the length of the dryer as the dryer is rotated.

9. An apparatus in accordance with claim 7 including lifting means for waste material attached to said interior wall surface, said lifting means raising waste material above said pipe cluster and allowing the waste material to drop downwardly into engagement with said pipe cluster.

10. An apparatus in accordance with claim 9 wherein said pipe cluster defines longitudinally extending troughs for receiving waste material from said lifting means, said troughs operating to temporarily hold waste material dropping downwardly from said lifting means.

11. An apparatus in accordance with claim 6 wherein aid reaction vessel comprises a rotary lime kiln.

12. A method for treating liquid-containing waste material comprising the steps of providing a reaction vessel, introducing material to be reacted to said reaction vessel, said reaction vessel including heating means for heating the vessel and the material therein to achieve a reaction which includes the formation of hot gases, providing a dryer, introducing said waste material to said dryer, introducing said hot gases from said reaction vessel to said dryer for heating said waste material to a temperature in excess of the boiling point of the liquid in said waste material, circulating said waste material within said dryer to maximize the exposure of the waste material to the heat in said hot gases, withdrawing from said dryer the waste gas generated by the boiling of said liquid, discharging from said dryer a solid portion of said waste material, and delivering said solid portion to said heating means for said reaction vessel to provide at least some of the fuel value required for operating said heating means, said dryer including a cluster of pipes located within said dryer and extending longitudinally and centrally of said dryer, and wherein means are provided for directing said waste material into engagement with the exterior surfaces defined by said pipe cluster, and including the steps of rotating said dryer whereby said waste material is continuously moved back and forth between said pipe cluster and the interior wall surface of said dryer, and introducing said hot gases from said vessel into the interior of said pipe cluster whereby heat from said hot gases is transmitted through the pipe walls to the waste material engaging said exterior surface.

13. An apparatus for treating liquid-containing waste material comprising a reaction vessel including means for receiving material to be reacted in the reaction vessel, said reaction vessel also including heating means for heating the vessel and the material therein to achieve a reaction which includes the formation of hot gases, a dryer, means for introducing said waste material to said dryer, means for introducing said hot gases from said reaction vessel to said dryer for heating said waste material to a temperature in excess of the boiling point of the liquid in said waste material, means formed by said dryer for circulating said waste material within said dryer to maximize the exposure of the waste material to the heat in said hot gases, means for withdrawing from said dryer the waste gas generated by the boiling of said liquid, means for discharging from said dryer a solid portion of said waste material, and means for delivering said solid portion to said heating means for said reaction vessel to provide at least some of the fuel value required for operating said heating means, said dryer comprising a cluster of pipes extending longitudinally and centrally of said dryer, means for directing said waste material into engagement with the exterior surfaces defined by said pipe cluster, and means for rotating said dryer whereby said waste material is continuously moved back and forth between said pipe cluster and the interior wall surface of said dryer, and means for introducing said hot gases from said vessel into the interior of said pipe cluster whereby heat from said hot gases is transmitted through the pipe walls to the waste material engaging said exterior surface.

14. An apparatus for treating liquid-containing waste material comprising a rotary lime kiln serving as a reaction vessel for receiving limestone to be calcined in the reaction vessel, said reaction vessel also including heating means for heating the vessel and the limestone therein to achieve a calcining reaction which includes the formation of hot gases, a dryer, means for introducing said waste material to said dryer, means for introducing said hot gases from said reaction vessel to said dryer for heating said waste material to a temperature in excess of the boiling point of the liquid in said waste material, means formed by said dryer for circulating said waste material within said dryer to maximize the exposure of the waste material to the heat in said hot gases, means for withdrawing from said dryer the waste gas generated by the boiling of said liquid, means for discharging from said dryer a solid portion of said waste material, and means for delivering said solid portion to said heating means for said reaction vessel to provide at least some of the fuel value required for operating said heating means.

* * * * *